US006655242B2

(12) United States Patent
Gambarini

(10) Patent No.: US 6,655,242 B2
(45) Date of Patent: Dec. 2, 2003

(54) TORQUE WRENCH WITH VARIABLE-ARM CLICKER MECHANISM

(75) Inventor: Lorenzo Gambarini, Milan (IT)

(73) Assignee: Tecnogi S.r.l., Milan (IT)

( * ) Notice: Subject to any disclaimer, the term of this patent is extended or adjusted under 35 U.S.C. 154(b) by 0 days.

(21) Appl. No.: 09/800,615

(22) Filed: Mar. 7, 2001

(65) Prior Publication Data

US 2001/0022121 A1 Sep. 20, 2001

(30) Foreign Application Priority Data

Mar. 8, 2000 (IT) ..... MI2000A0450

(51) Int. Cl.[7] ..... B25B 23/147
(52) U.S. Cl. ..... 81/479; 81/481; 73/862.23
(58) Field of Search ..... 81/467, 478, 479, 81/481, 483; 73/862.23

(56) References Cited

U.S. PATENT DOCUMENTS 3,170,346 A * 2/1965 Ochs ..... 81/481
3,308,690 A * 3/1967 La Pointe ..... 81/478
4,655,104 A * 4/1987 Blattner ..... 81/483
5,156,072 A * 10/1992 Muralidharan ..... 81/478
5,911,801 A * 6/1999 Fravalo et al. ..... 81/478

* cited by examiner

*Primary Examiner*—James G. Smith
(74) *Attorney, Agent, or Firm*—Hedman & Costigan, P.C.

(57) ABSTRACT

A torque wrench (40) with a variable-arm clicker mechanism, comprises a substantially tubular body (41), equipped with a handgrip (18) from which protrudes a ratchet gear element (4), suited for engaging with the blocking device which must be tightened. Inside the tubular body (41) is the clicker mechanism, which comprises a main lever (2) ending with the ratchet gear element (4), with fulcrum on the same tubular body (41) by means of a pin (3). The clicker mechanism has a pair of parallel intermediate levers (6), hinged on a fulcrum (10), integral with a mobile carriage (9), where the parallel intermediate levers (6) extend within the carriage (9) through slots (31, 32) which act as guides for the levers and are connected by means of a pin (12) to small levers (22) which command a push rod (20) that operates a spring (16).

12 Claims, 4 Drawing Sheets

TORQUE WRENCH WITH VARIABLE-ARM CLICKER MECHANISM

The present application claims priority to Italian Patent Application Serial No. MI 2000A 000450, filed Mar. 8, 2000.

BACKGROUND OF THE INVENTION

The present invention relates to a torque wrench with variable-arm clicker mechanism.

As is known, there are various torque wrenches in existence, in particular equipped with a variable-arm clicker mechanism, which are used for applying a pre-established tightening torque on fastening devices such as bolts, nuts and similar.

Torque wrenches generally have a tubular body, equipped with a handgrip, on which is applied a ratchet gear mechanism having, on one face, a suitable protruding part or cavity which allows it to mate with the fastening device that is to be tightened.

This purpose of this ratchet gear is to form a solid connection, only in the tightening direction, with a portion of the mechanism which mates with the fastening device and with the tubular body, thus tightening the fastening device.

Inside the tubular body is a so-called "clicker" mechanism which, when the pre-established tightening torque has been applied on the fastening device, allows a further limited rotation of the tubular body in the tightening direction without this additional rotation having any effect on the fastening device.

In this way, when the user feels this clicking rotation in the tightening direction, he understands that the desired torque has been applied on the fastening device.

An example of these torque wrenches is described in the patent for an industrial invention No. IT 1191798.

It presents, among other things a torque wrench clicking and resetting mechanism, operated by a spring, for determining the clicking movement of the above-mentioned clicker mechanism.

The torque wrench reset mechanism comprises a first transmission lever, which is hinged on a pin arranged substantially at the same height as a second pin on which is hinged a second transmission lever.

When the pre-established tightening torque is applied on the nut or bolt to be tightened, one of the above-mentioned levers rotates in the opposite direction to the tightening direction, causing consequent rotation of the second lever and these rotations take place with a clicking movement, thus preventing further tightening of the nut or bolt once the pre-established tightening torque has been applied on them.

Although a torque wrench such as the one described is able to perform the function for which it was designed, some interesting and important improvements may be made.

SUMMARY OF THE INVENTION

In this torque wrench there are in fact a high number of components which are used to realise the linkages necessary to make the clicking and reset of the wrench.

Moreover some components are difficult to make and are therefore expensive, and are also subject to premature wear because they have areas with concentrated loads that are too high.

The aim of the present invention is therefore to realise a torque wrench with a variable-arm clicker mechanism, with a distinctly simpler construction than the prior art.

A further aim of the present invention is to realise a torque wrench with a reduced number of components.

Another aim of the present invention is to indicate a torque wrench with high repeatability, reliability and long life.

Not the least aim of the present invention is to indicate a torque wrench that is easy to realise and therefore with low costs.

These and other aims are achieved by a torques wrench with a variable-arm clicker mechanism, comprising a substantially tubular body (41), equipped with a handgrip (18) from which protrudes a ratchet gear element (4) to engage a blocking device (14) which must be tightened, wherein inside said tubular body (41) is said variable-arm clicker mechanism, said variable-arm clicker mechanism comprising a main lever (2) having a first end and a second end and having on said first end said ratchet gear element (4) and on said second end a T shaped element (5), said main lever (2) being mounted on said tubular body (41) by means of a first pin (3), wherein said variable-arm clicker mechanism has a pair of parallel intermediate levers (6), hinged on a fulcrum (10), which is integral with a movable carriage (9), said parallel intermediate levers (6) being extended within said movable carriage (9) through a pair of slots (31, 32) and being connected by means of a second pin (12) to a pair of small levers (22) hinged by a third pin (21) onto a roller (15) which acts on a push rod (20) to operate a resilient means (16).

Further characteristics of the present invention are also defined in the subsequent claims.

BRIEF DESCRIPTION OF THE DRAWINGS

Further aims and advantages of the present invention will be clear from the following description and from the annexed drawings, supplied purely as an illustrative example, without limitation, in which.

DETAILED DESCRIPTION OF THE INVENTION

Figure 1:
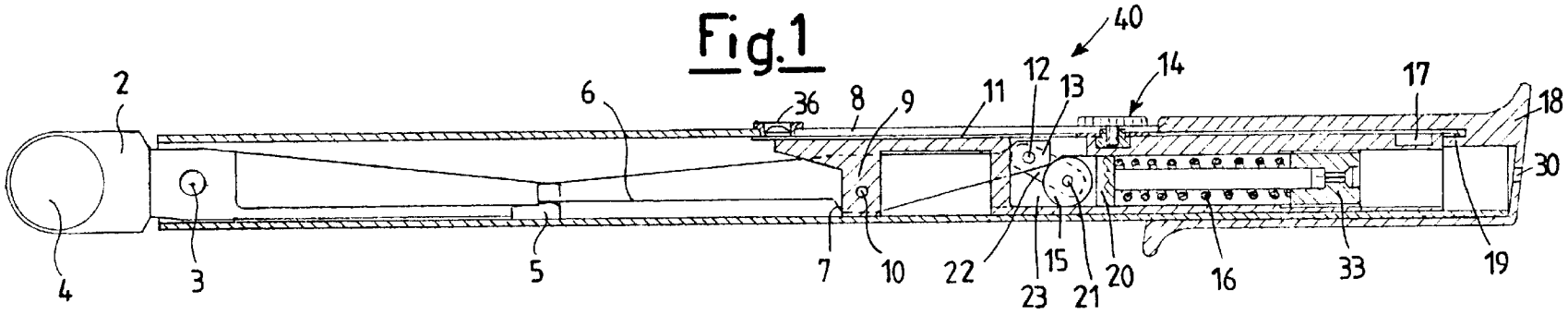
FIG. 1 shows a longitudinal section of the torque wrench in the invention, with mechanism at rest and minimum torque position.
Figure 2:
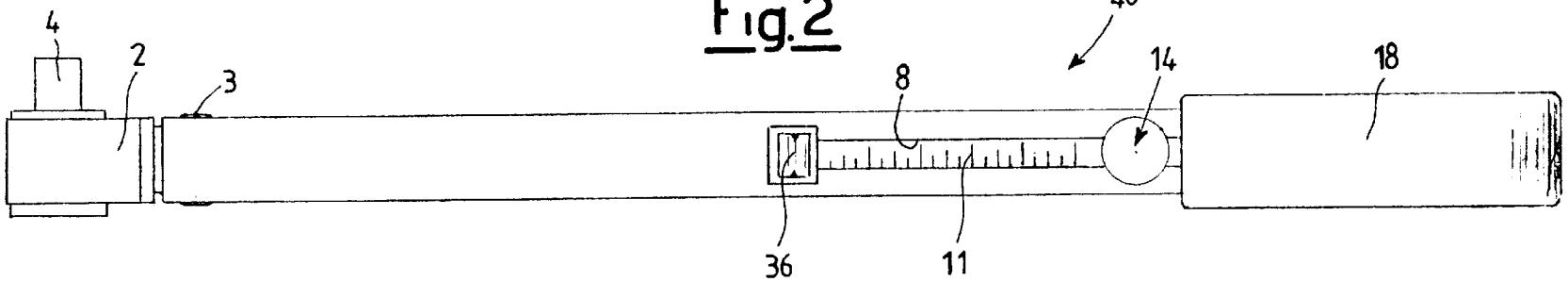
FIG. 2 is a plan view of the torque wrench in the invention.
Figure 3:
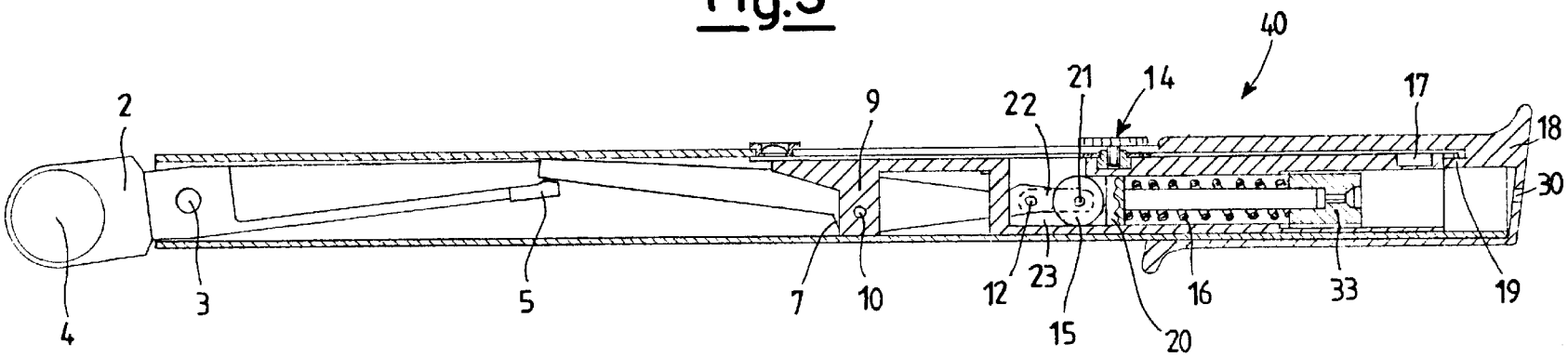
FIG. 3 is a longitudinal section, similar to FIG. 1, but with the mechanism at end of stroke after the click.
Figure 4:
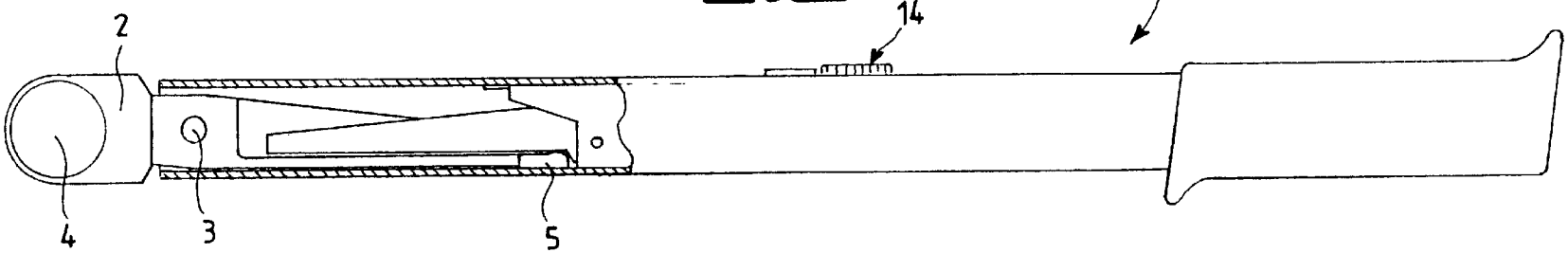
FIG. 4 is a longitudinal view, partly in section, in which the mechanism regulated at maximum torque is visible.
Figure 5:
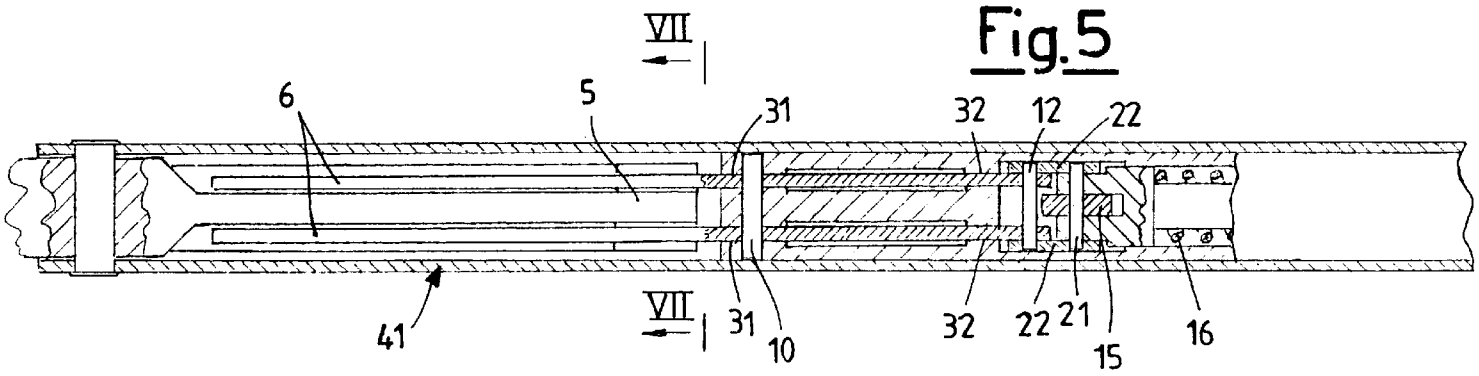
FIG. 5 is a section plan view showing the main components of the torque wrench in the invention.
Figure 6:
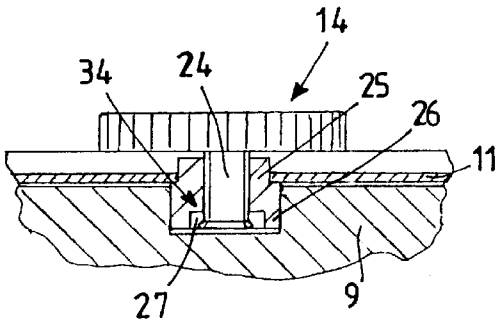
FIG. 6 is an enlarged section of the blocking device belonging to the torque wrench in the invention.
Figure 7:
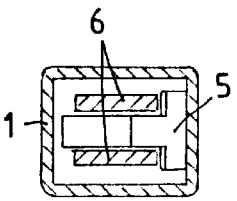
FIG. 7 is a cross section, through the plain VII—VII of FIG. 5, showing the form of the main lever and of two intermediate levers.
Figure 8:
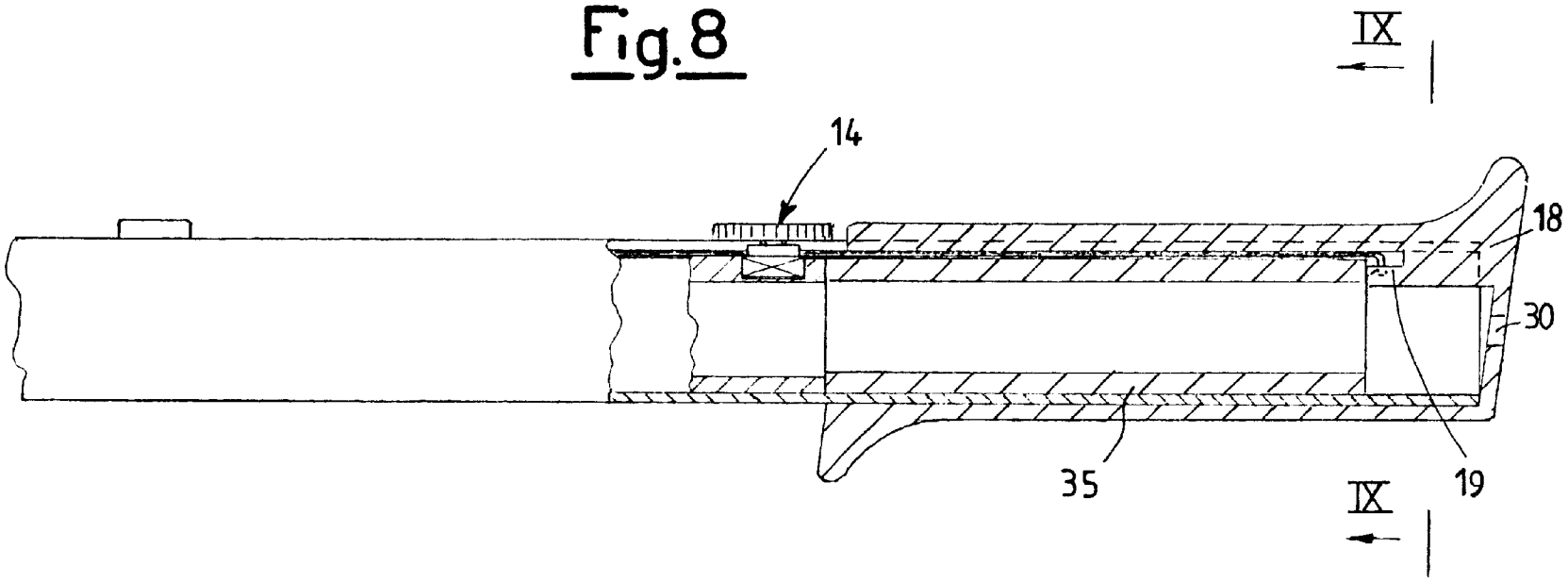
FIG. 8 is a partial longitudinal section showing a blocking device of the wrench, housed in a receding position.
Figure 9:
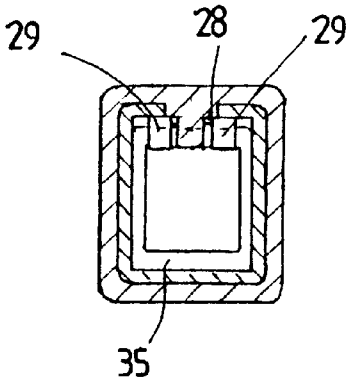
FIG. 9 is a cross section, through the plain IX—IX of FIG. 8, showing the folded tabs of a graduated scale, as well as the shape of the catch on the handgrip and that of the spacer.

With particular reference to the figures mentioned, it is noted how the structure of the torque wrench, indicated overall with the reference number 40, is composed of a single tube 41, with a substantially rectangular section, within which is inserted on one side a main lever 2, with fulcrum 10 on the same tube 41, by means of a first pin 3.

The main lever 2 ends with a ratchet mechanism 4 (or jack), suited to engage with the blocking device which must be tightened.

A portion of the main lever 2, inside the tube 41, is shaped, in cross section, like an upside-down T and at its end 5 it is made in such a way as to be able to activate a pair of parallel intermediate levers 6, practically rolling on them, therefore with practically negligible friction.

The intermediate levers 6 are hinged on a fulcrum 10, which is integral with a carriage 9; the intermediate levers 6 protrude from the mobile carriage 9 so that they are arranged next to the main lever 2 and then move with respect to it to vary the using torque of the torque wrench 40.

Moreover, the intermediate levers 6 present a nib 7 which stops the stroke of the carriage 9 when it is shifted to obtain maximum torque.

It should be noted that the intermediate levers 6 extend inside the carriage 9 through the slots 31 and 32 which act as guides for the levers themselves, so as to keep them parallel to the main lever 2.

The intermediate levers 6, ending with a portion 13, arrive in a hollow 23, where they are connected by means of a second pin 12 to a small lever 22.

The small levers 22 are hinged (by a third pin 21) onto a roller 15 which supports the transverse thrust, reducing friction during operation of the torque wrench 40.

Moreover, the small levers 22 command a push rod 20 that operates a spring 16 which may be calibrated; the spring 16 is regulated by means of the nut 33 only in the final calibration phase of the wrench 40, through a hole 30.

A suitable handgrip 18 closes the final part of the tube 41 and, by means of a protrusion 19, determines stopping at end of stroke of the carriage 9, when the torque wrench 40 is regulated at minimum torque.

The carriage 9 therefore comprises all the mechanisms that make up the clicking device of the torque wrench 40.

It also comprises a graduated scale 11 and a blocking device 14 that blocks the carriage 9 in the desired position.

The graduated scale 11, not represented in detail, is visible by means of the through slot 8 in the tubular body 41; there is also a lens 36 which facilitates reading of the graduated scale 11.

The position of the carriage 9 (depending on the torque regulation) is fixed by means of a blocking device 14 formed by a special nut (34), having a base (26) with a square section, and a round hub 25 which, passing through the graduated scale 11, pulls the scale together with the carriage 9.

A screw with a large head 24 then blocks the device 14.

As may be noted, the special nut 34 presents a seat 27 to contain the end of the screw which is lightly riveted to avoid its complete unscrewing and therefore the possibility of being lost.

The blocking device 14 is fitted in one of the two seats 17 present in the carriage 9 and is inserted in the tube 41, together with the carriage 9 and the graduated scale 11, through the slot 8 in the tube 41.

The blocking device 14 is fitted in the front seat, as indicated in FIG. 1, for wrenches that reach a maximum capacity of about 200 Nm and so the total length of the wrench 40 is such that the force to be applied on the handgrip, to reach maximum torque, assumes a reasonable value.

Obviously, the graduated scale 11 will move together with the blocking device 14.

The operation of the torque wrench 40, according to the present invention, is briefly illustrated below.

The ratchet gear element 4 is engaged with the blocking device which is to be tightened and, by means of the handgrip 18, the user performs a rotation of the tubular body 41 of the torque wrench 40.

Following this movement, the main lever 2, by means of its end 5, activates the pair of intermediate levers 6, rolling on them.

The intermediate levers 6 rotate around the fulcrum 10, moving the small levers 22, which in turn rotate around the third pin 21 until the second pin 12 is substantially aligned with the third pin 21 and with the fulcrum 10; this position in which the mechanism described is at the end of stroke after having made one click.

In this situation, the pre-established tightening torque has therefore been applied on the device to be tightened.

In this situation, the spring 16 is temporarily compressed and allows the small levers 22 to perform an anti-clockwise rotation to go near the position in which the second pin 12, third pin 21 and the fulcrum are substantially aligned.

The spring 16, in this condition, once the action of the torque exerted by the main lever 2 has ceased, is extended in the initial position, bringing the small levers 2 back to their initial position.

The using torque of the torque wrench 40 may be varied, within certain limits, according to requirements, by shifting the mobile carriage 9, thus varying the distance between the fulcrum 10 and the end 5 of the main levers 2 on which the intermediate levers 6 act.

The nib 7 allows the stroke of the carriage 9 to be stopped when it is shifted to obtain maximum torque.

As indicated previously, the position of the carriage 9 (and therefore the torque regulation) is fixed by means of the blocking device 14, acting on the screw 24.

Also the resistant force of the spring 16 may be calibrated by means of the nut 33, turning it through the hole 30.

To obtain wrenches with a more reduced maximum torque, the regulation of the contrast spring 16 may be adjusted, or the spring 16 may be replaced with a spring that has a lower load.

To obtain wrenches with a higher torque up to about 300–350 Nm, the main lever 2 must be replaced with a lever on which the part inside the tube 41 is suitably longer, so as to increase the arm on which the intermediate levers 6 act.

For this purpose there is also a spacer 35 which, among other things, supports the graduated scale 11, on which there are two folded tabs 29 which pull the spacer 35, as far as a stop 28, during the regulating stroke of the wrench 40.

For example, if the extension is 50%, the torque too will increase by about the same amount, but obviously the total length of the wrench 40 will increase in a much smaller proportion, and so the force that must be exerted on the handgrip to obtain the maximum torque will be too high and the wrench will therefore lose functionality.

To avoid this problem, the blocking device 14 is inserted in the second seat 17 in the carriage 9.

As may be seen, the rectangular-section tube of the torque wrench 40 must be extended, not only the difference of the length of the main lever 2, but also by an amount equal to the distance between the first and the second seat of the blocking device 14.

The length of the wrench 40 is therefore again proportional to the maximum torque that it must develop and so the force to be exerted on the handgrip becomes acceptable again.

Obviously, along with the blocking device 14 the graduated scale 11 also moves and, in order to be able to stop the movement of the carriage 9, towards minimum torque position, a spacer 35 is inserted which also supports the gradual scale 11, on which there are two folded tabs 29 which pull the spacer 35 during the regulating stroke of the wrench 40.

As may be seen, the various components of the torque wrench 40 are simple, easy to make and to assemble, and so the costs of making it become quite low.

From the description given, the characteristics of the torque wrench to which the present invention refers are clear, just as its advantages are clear.

To define these advantages more precisely, the following considerations are now made.

The torque wrench 40 in the invention allows a considerable reduction of the number of components, it has very simple components and considerable repeatability and reliability.

The invention offers the possibility of realising a torque wrench with a relatively high capacity, modifying the total length of the torque wrench by an amount higher than the variations of the main lever, changing the seat 17 in which the fixing device 14 is inserted from front to rear, so as keep the same working of the tube in the rear area thus containing the length of the hollow.

The formation of the end of the main lever and the arrangement of the changes of rotation, both of the main lever 2 and of the intermediate levers 6, allow a positioning to be held with minimum rubbing and practically no axial reaction.

It is possible to pre-assemble the fixing device 14 so as to lightly rivet the end part of the screw, thus preventing total unscrewing with loss of the screw itself.

The fixing device 14 is realised with a special nut and bolt obtained from a square-section bar, so as not to have to make any additional working apart from turning.

The cylindrical hub of the above-mentioned nut passes through a hole made in the graduated scale 11 so as to pull it during the torque adjustment phase.

The graduated scale 11 presents an end provided with folded tabs to pull the stop spacer which also acts as support for the graduated scale.

The formation of the intermediate lever is such as to realise also the stop for axial regulation against the end part of the main lever.

Finally it is clear that numerous variations may be made to the torque wrench to which this invention refers, without for this reason departing from the inherent principles of innovation of the inventive idea.

In the practical realisation of the invention, the materials, forms and dimensions of the details illustrated may be whatever required and they may be replaced with others that are technically equivalent.

What is claimed is:

1. A Torque wrench (40) with a variable-arm clicker mechanism, comprising a substantially tubular body (41), equipped with a handgrip (18) from which protrudes a ratchet gear element (4) to engage a blocking device (14) which must be tightened, wherein inside said tubular body (41) is said variable-arm clicker mechanism, said variable-arm clicker mechanism comprising a main lever (2) having a first end and a second end and having on said first end said ratchet gear element (4) and on said second end a T shaped element (5), said main lever (2) being mounted on said tubular body (41) by means of a first pin (3), wherein said variable-arm clicker mechanism has a pair of parallel intermediate levers (6), hinged on a fulcrum (10), which is integral with a movable carriage (9), said parallel intermediate levers (6) being extended within said movable carriage (9) through a pair of slots (31, 32) and being connected by means of a second pin (12) to a pair of small levers (22) hinged by a third pin (21) onto a roller (15) which acts on a push rod (20) to operate a resilient means (16).

2. A Torque wrench (40), according to claim 1, wherein an end (13) of said intermediate levers (6) extends from said roller (15) within said movable carriage (9) through said slots (31, 32) which act as guides for said intermediate levers (6) which rest on said T shaped element (5) of said main arm (2).

3. Torque wrench (40), according to claim 1, wherein said pair of small levers (22) are hinged on said roller (15) which supports any transverse thrust of said intermediate levers (6).

4. A Torque wrench (40), according to claim 1, wherein the position of said movable carriage (9) is fixed by means of said blocking device (14), comprising a special nut (34), having a base (26) with a square section that is secured by means of screw with a large head (24).

5. A Torque wrench (40), according to claim 4, further comprising a graduated scale (11), visible by means of a through slot (8) in said tubular body (41).

6. A Torque wrench (40), according to claim 4, wherein said blocking device (14) further comprises a round hub (25) which when said round hub (25) is passed through a graduated scale (11), moves said graduated scale together with said movable carriage (9).

7. A Torque wrench (40), according to claim 4, further comprising a lens (36) which facilitates reading of said graduated scale (11).

8. A Torque wrench (40), according to claim 1, wherein said handgrip (18) closes the end part of said tubular body (41) and comprises a protrusion (19) which acts as a stop when movable carriage (9) is moved as said torque wrench (40) is set at a minimum torque.

9. A Torque wrench (40), according to claim 1, wherein said intermediate levers (6) further comprise a nib (7) which stops the movement of said movable carriage (9) when said movable carriage (9) is shifted to obtain maximum torque.

10. A Torque wrench (40), according to claim 4, wherein said blocking device (14) is housed in a seat (17) in said movable carriage (9).

11. A Torque wrench (40), according to claim 10, wherein a spacer (35) is inserted to stop the movement of said movable carriage (9) and to support a graduated scale (11).

12. A Torque wrench (40), according to claim 11, wherein said spacer (35) is pulled during regulation by means of a folded tab (29) of said graduated scale (11).

* * * * *